US005946838A

United States Patent [19]

Lanoue

[11] Patent Number: 5,946,838

[45] Date of Patent: Sep. 7, 1999

[54] MAILBOX CLIP HAVING DETACHABLE DECORATIVE PANELS

[76] Inventor: Pamela A. Lanoue, 1438 Bullrush Dr., Baton Rouge, La. 70810

[21] Appl. No.: 09/145,049

[22] Filed: Sep. 1, 1998

[51] Int. Cl.[6] ..... G09F 7/02

[52] U.S. Cl. ..... 40/611; 40/666; 211/71.01; 211/113; 248/205.1

[58] Field of Search ..... 40/566, 606, 611, 40/666; 232/38; 211/71.01, 113; 248/205.1, 213.2, 224.7

[56] References Cited

U.S. PATENT DOCUMENTS 2,976,633 3/1961 Squire ..... 40/606
5,711,433 1/1998 Smith ..... 211/71.01

*Primary Examiner*—Ramon O. Ramirez
*Attorney, Agent, or Firm*—Ronald E. Smith

[57] ABSTRACT

A mailbox clip is releasably attachable to a mailbox and enables a user to display signs indicating club affiliations, sports team loyalties, hobbies, and the like. The clip has an arch-shaped top part that overlies an arch-shaped top wall of a conventional mailbox. A pair of arm members having a common length are integrally formed with and extend from opposite ends of the top part in transversely opposed relation to one another. The arm members are slightly convergent relative to one another to enhance their grip on opposing side walls of the mailbox. Each arm member terminates in a return bend, and a straight mounting member extends from each return bend in generally parallel relation to its associated arm member. A panel is releasably attachable to each straight mounting member, and a preselected indicia is imprinted upon a first or outward side of each panel. A second or inward side of each panel includes an elongate hollow socket member that slideably receives its associated straight mounting member so that a user may change panels and thus indicia as frequently as desired.

14 Claims, 5 Drawing Sheets

MAILBOX CLIP HAVING DETACHABLE DECORATIVE PANELS

BACKGROUND OF THE INVENTION

1. Field of the Invention

This invention relates, generally, to mailbox attachments. More particularly, it relates to a structure that is removably retrofit onto existing mailboxes for decorative and informative purposes.

2. Description of the Prior Art

There are a number of structures that are adapted for removable attachment to a conventional mailbox for decoration and information purposes. Some of them cover the entire mailbox and thus use a substantial amount of materials. Moreover, some of them provide mounting means that enable a homeowner to mount decorative elements thereon, but the mounting means are of complex construction, are not easy to use, and in some cases are unattractive.

There remains a need, therefore, for an improved structure for removable attachment to a mailbox. The improved structure should be made of a minimal amount of materials, it should facilitate the easy replacement of decorative or informative panels, and it should have aesthetic appeal.

However, in view of the art considered as a whole at the time the present invention was made, it was not obvious to those of ordinary skill in this art how the needed improvements could be provided.

SUMMARY OF THE INVENTION

The long-standing but heretofore unfulfilled need for an apparatus that overcomes the limitations of the prior art is now met by a new, useful, and nonobvious invention. The present invention includes an attractive mailbox clip that is releasably attachable to a mailbox for decorative purposes. It includes an arch-shaped top part adapted to overlie an arch-shaped top wall of a mailbox of the type having an arch-shaped top wall. It further includes a pair of arm members integrally formed with respective opposite ends of the arch-shaped top part. The arm members share a common length and they respectively extend from said opposite ends in transversely opposed relation to one another. The arm members are disposed in slightly convergent relationship to one another so that they cooperatively grip opposite side walls of a mailbox to which the mailbox clip is attached. Each of the arm members terminate in an integrally formed return bend. A straight mounting member is integrally formed with each of the return bends and each straight mounting member is disposed in substantially parallel, closely spaced relation to an associated arm member. The straight mounting members have a common length substantially equal to the common length of the arm members.

The novel assembly further includes a first and a second panel member, each of which has a first side adapted to have a preselected indicia disposed thereupon and each of which has a second side adapted for releasable attachment with one of the straight mounting members. An elongate hollow socket means is secured to or integrally formed with each of the second sides, and each of the elongate socket means is adapted to slideably receive an associated straight mounting member. Each elongate socket means includes three side walls disposed normal to the second side and an opening flush with a peripheral edge of its associated panel member for receiving a straight mounting member. Moreover, in a first embodiment each socket means includes a flange connected to each of the three side walls. The flange overlies the second side of its associated panel member to facilitate attachment of the socket means to said second side and to stabilize the connection. In a second embodiment, the flange is eliminated in favor of an integral construction where the socket means and the panel are of one piece construction.

It is a primary object of this invention to provide an aesthetically-pleasing mailbox clip that is easily attached to a mailbox and just as easily removed therefrom.

Another object is to provide such a clip that enables the easy changing of decorative or informative panels.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
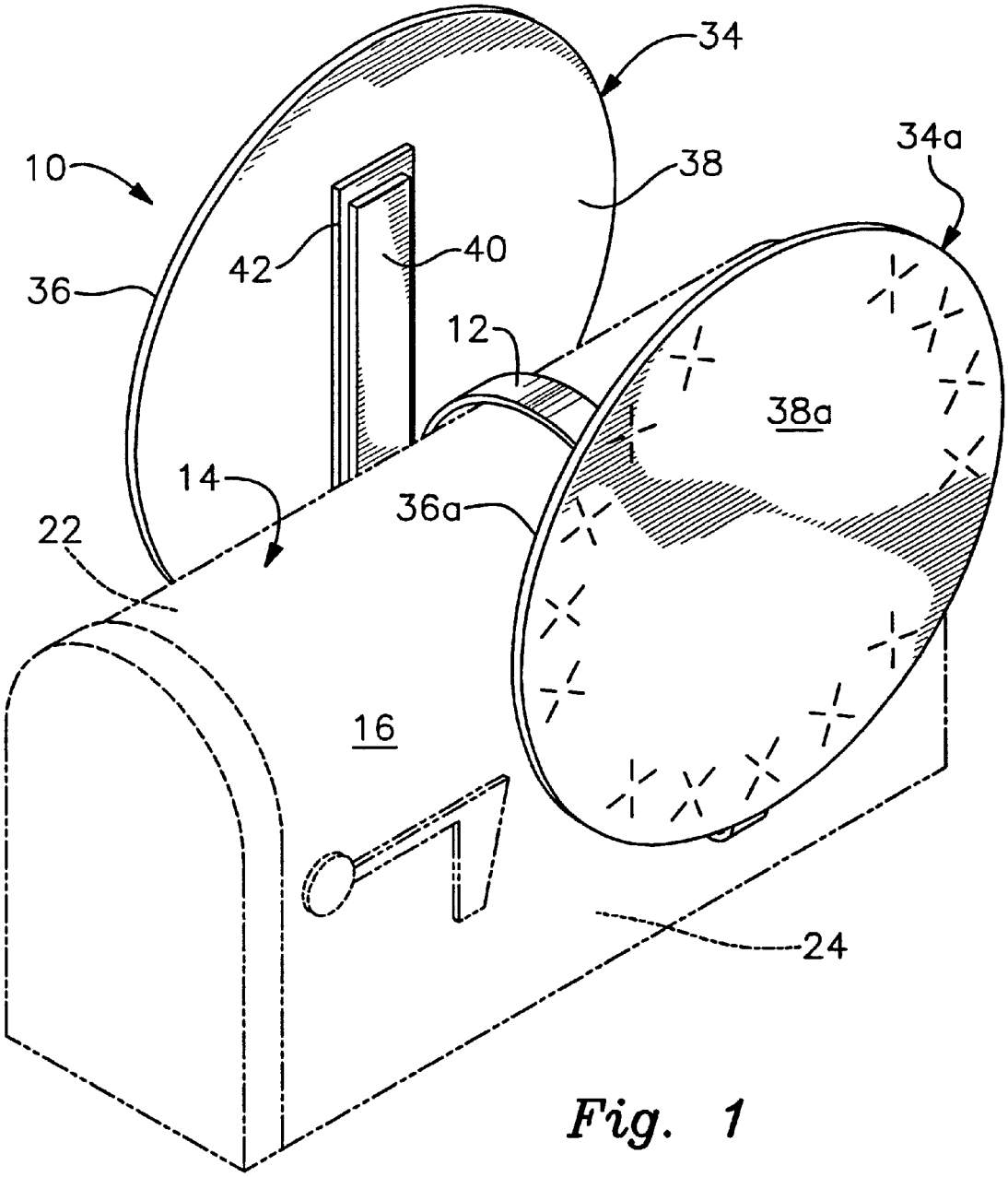
FIG. 1 is a perspective view of the novel mailbox clip when attached to a mailbox.
Figure 2:
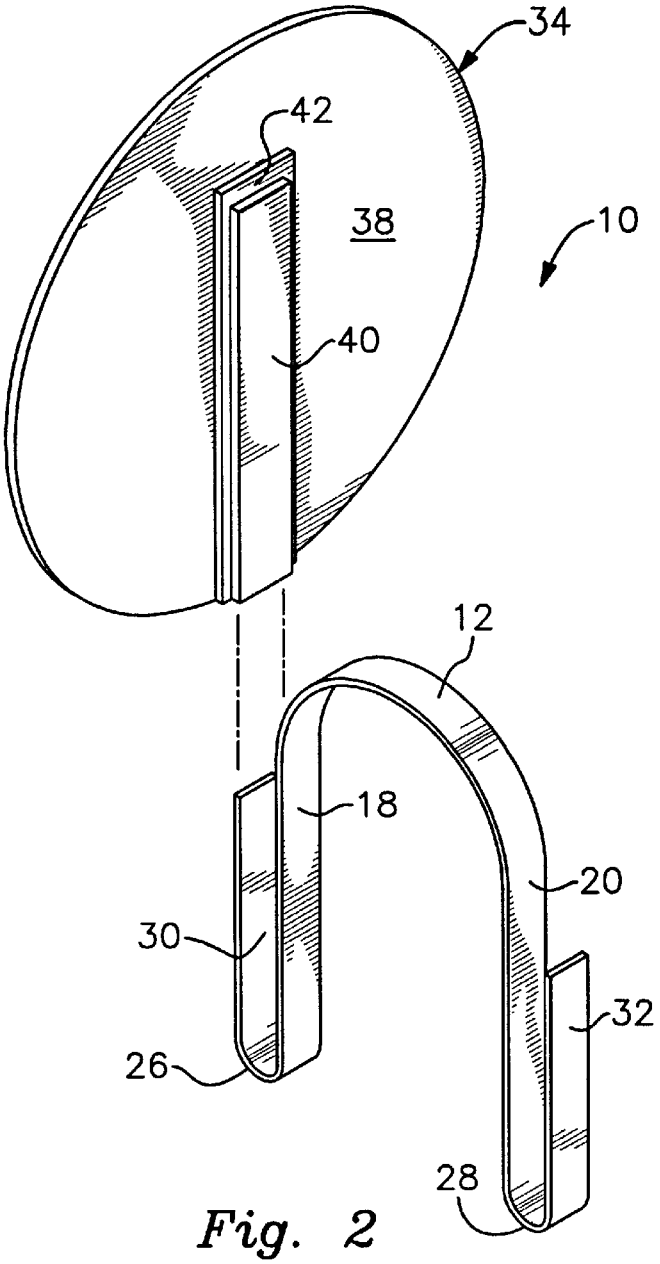
FIG. 2 is an exploded perspective view of the novel clip and a panel.
Figure 3:
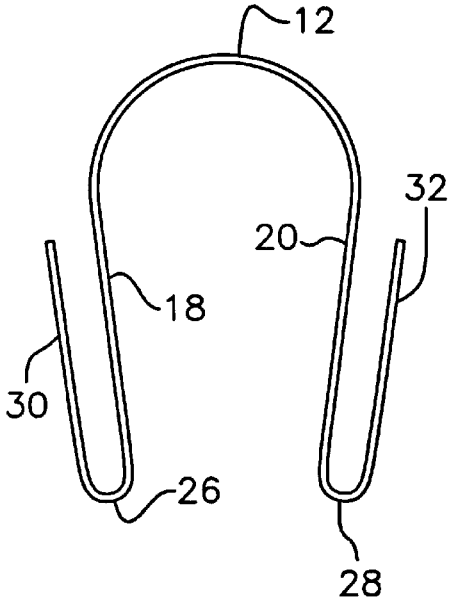
FIG. 3 is a front elevational view of the novel clip.

Referring now to FIGS. 1–3, it will there be seen that an illustrative embodiment of the invention is denoted as a whole by the reference numeral 10.

Mailbox clip 10 includes a base member having an arch-shaped middle part 12 that conforms to and overlies the arch-shaped top 14 of a conventional mailbox 16 when the clip is in use.

A pair of transversely opposed side arms 18, 20 (FIGS. 2, 2A and 3) are formed integrally with top part 12. Said side arms are disposed in slightly converging relation to one another when in repose as best depicted in FIG. 3 so that they grip opposing side walls 22, 24 of mailbox 16 when device 10 is attached to said mailbox.

A return bend 26, 28 is integrally formed in the respective free ends of said side arms, and a generally upstanding mounting member 30, 32 is integrally formed with each return bend. Mounting members 30, 32 are disposed in parallel relation to side arms 18, 20 in closely spaced relation to their associated side arms.

The novel base member is formed of a preselected flexible and resilient material.

A first panel 34 has a first or forward side 36 (FIG. 1) and a second or rearward side 38. First side 36 is adapted to have a preselected indicia means disposed thereupon by suitable means. The indicia means could be the logo of a sports team, the name and logo of a club, a painting, and the like.

In a first embodiment, an elongate hollow socket means 40 is permanently secured to second side 38; mounting member 30 is slideably receivable within the space enclosed by the socket means and second side 38 of panel 34. A flange 42 is provided at the perimeter of the socket means to facilitate and stabilize the connection between second side 38 and the walls of the socket means that are normal to the plane of said second side 38.

A second panel 34*a* has a first side 36*a* and a second side 38*a*. First side 36*a* is adapted to have a preselected indicia means disposed thereupon by suitable means. The indicia means could be the logo of a sports team, the name of a club, a painting, and the like. It could match the indicia on the first side 36 of first panel 34, but such matching is not required.

A second elongate hollow socket, which is not visible in the drawing but which has the same structure as socket 40, is permanently secured to second side 38*a*, with the aid of suitable flanges. Said second socket is adapted to slideably and snugly receive mounting member 32.

The elongate hollow sockets have a common extent and both have an open end for slideably receiving an associated mounting member 30, 32. The open end may be flush with the perimeter of its associated panel as depicted in FIG. 2 but it need not be.

Each elongate hollow socket defines an elongate cavity that substantially conforms to the respective lengths and transverse cross-sectional shapes of mounting members 30, 32 to provide a releasable but snug fit.

Figure 2A:
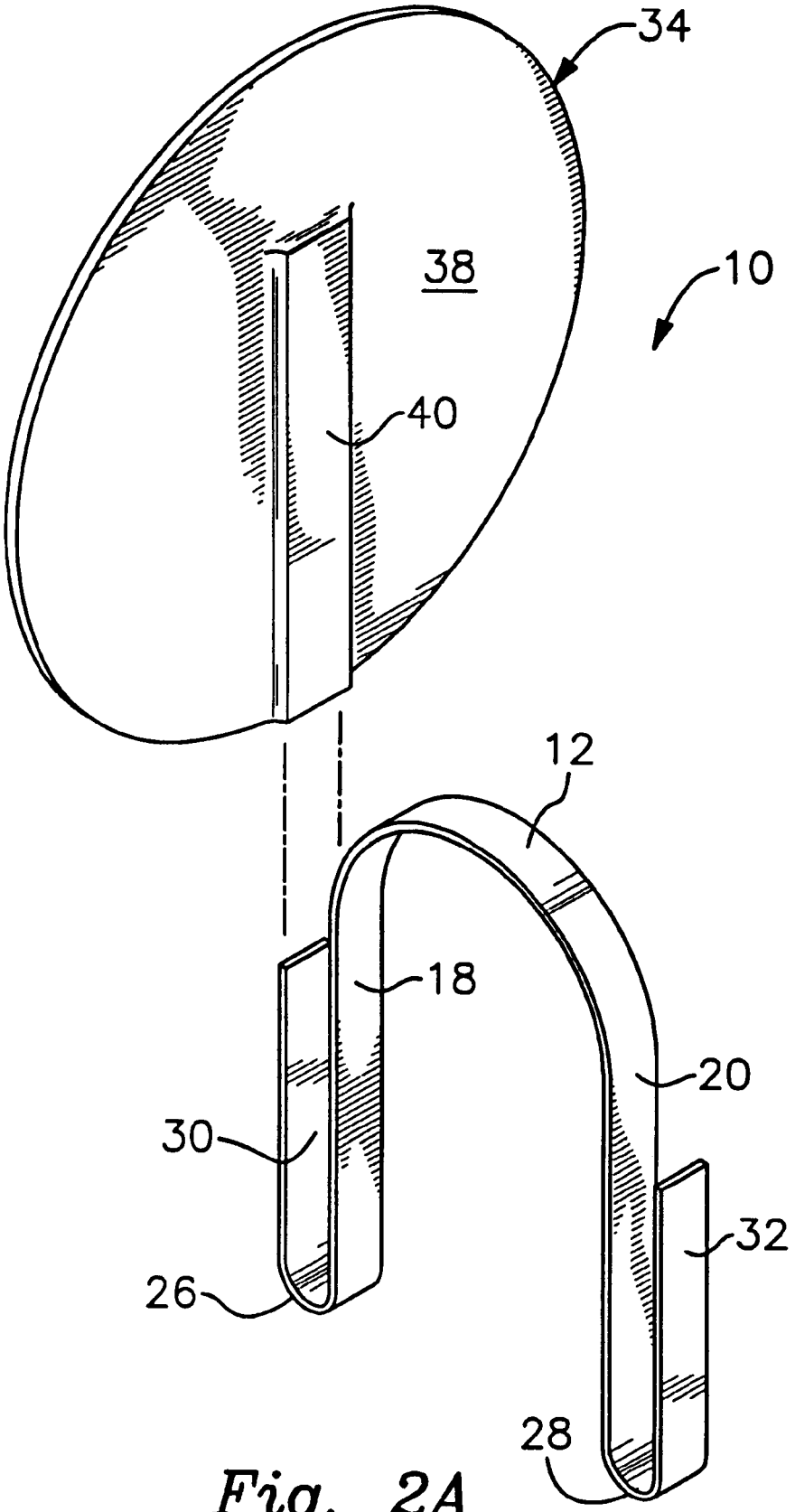
FIG. 2A depicts a second embodiment where the panel and socket means are formed integrally with one another.

In the embodiment of FIG. 2A, flange 42 is eliminated by making panel 34 and socket 40 integral with one another. Three sidewalls of socket means 40 gradually merge with second side 38 of panel 34 as depicted and the fourth side is open to receive its associated straight mounting member. This lowers manufacturing costs by eliminating the step of attaching socket 40 to rear side 38 of panel 34 at the time of manufacture. Panel 34*a* is made the same way.

Note that the common longitudinal extent of top part 12, side arms 18, 20, return bends 26, 28 and mounting members 30, 32 is nominal relative to the longitudinal extent of mailbox 16. This provides a savings in materials and makes device 10 light-in-weight.

Panels 34, 34*a* may be of any practical configuration and dimension; they are not limited to the particular shape and size depicted in the drawings.

Figure 4:
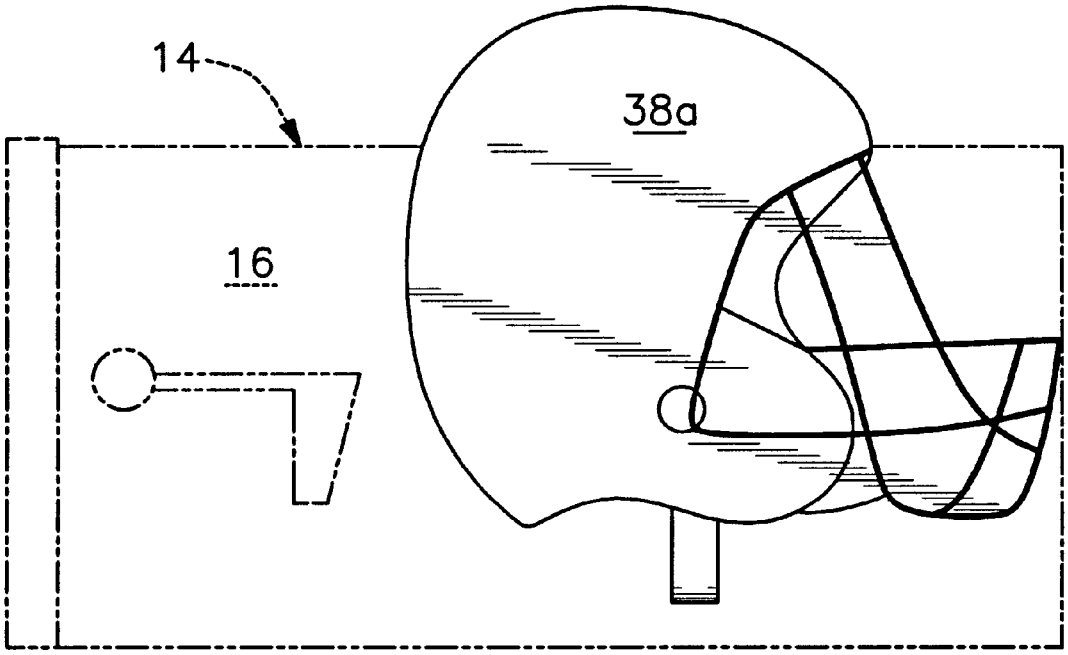
FIG. 4 is a side elevational view of a first exemplary embodiment of the novel assembly when attached to a mailbox.
Figure 5:
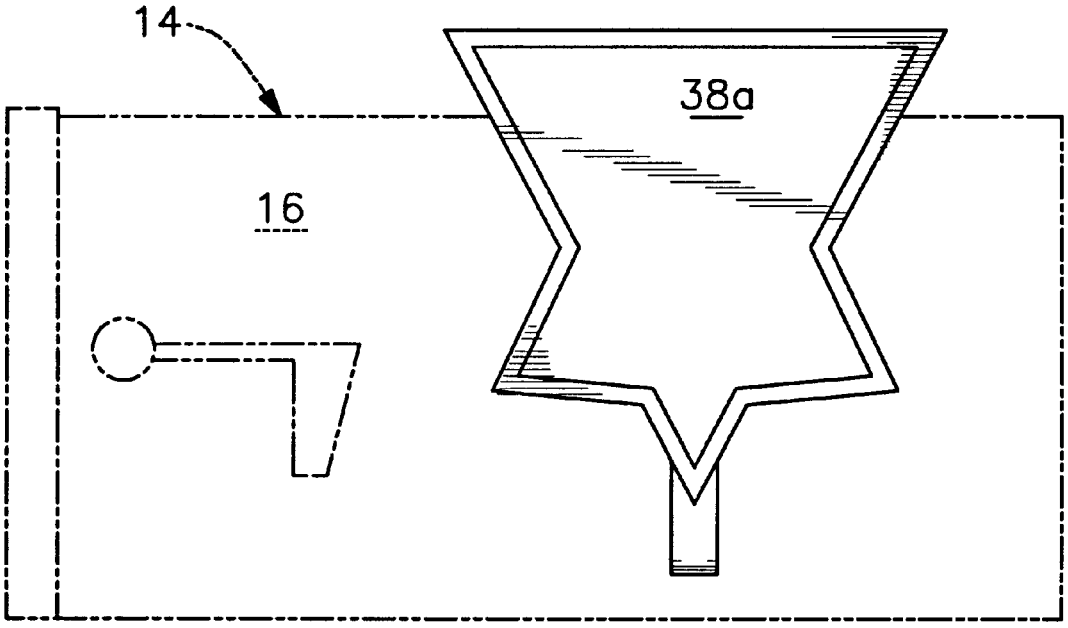
FIG. 5 is a side elevational view of a second exemplary embodiment of the novel assembly when attached to a mailbox.
Figure 6:
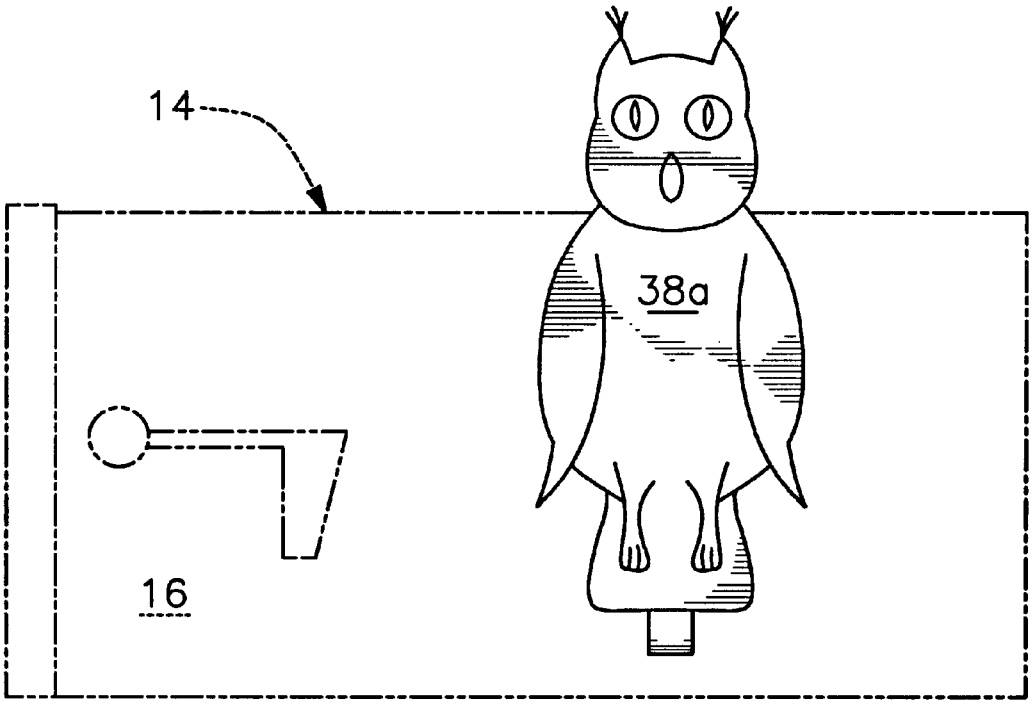
FIG. 6 is a side elevational view of a third exemplary embodiment of the novel assembly when attached to a mailbox.
Figure 7:
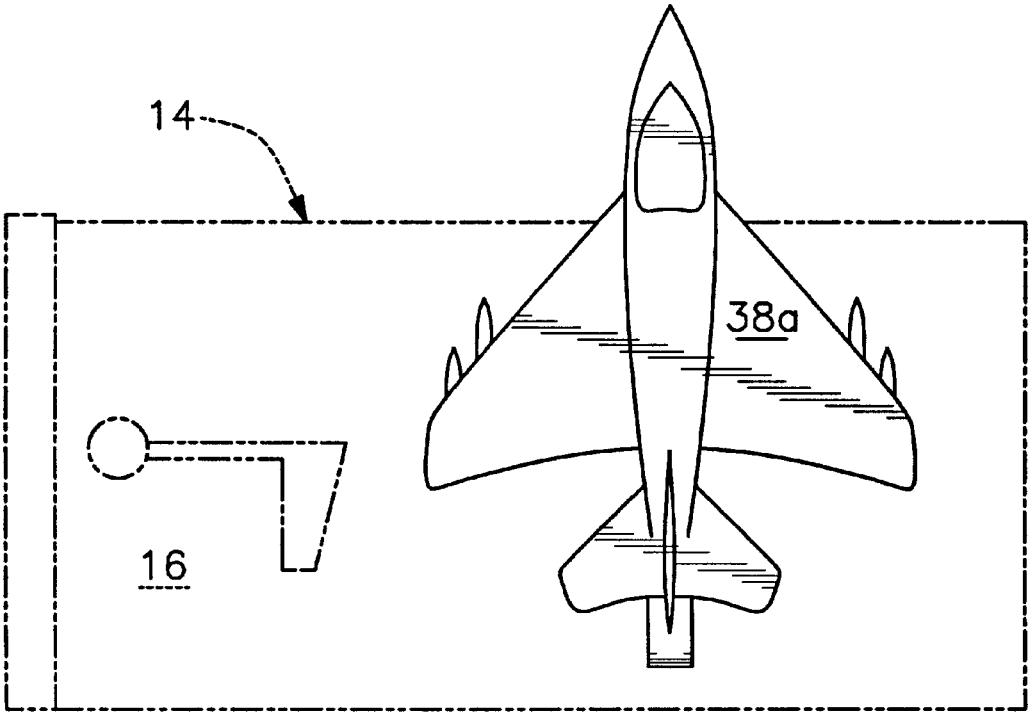
FIG. 7 is a side elevational view of a fourth exemplary embodiment of the novel assembly when attached to a mailbox.

Indicia of the user's choice may be applied to the respective first sides of the panels to enable a user to display loyalty to a sports team, a band, a political or religious affiliation, or the like, as suggested by FIG. 4. Alternatively, the user may prefer to display art work of any nature, Including scenes appropriate to the season of the year, and so on, without limitation. Bases 34 and 34*a* need not be round, but may be of any predetermined geometrical configuration as indicated in FIG. 5. FIGS. 6 and 7 indicate that the novel clip may be employed to display objects of art or objects associated with one's hobbies or interests.

A user need purchase only one base which consists of a top part 12, side arms 18, 20, return bends 26, 28 and mounting members 30, 32, all formed integrally with one another as aforesaid; the number of panels 34, 34*a* a user may elect to own is unlimited. In this way, a user may express his or her personality, including likes and dislikes, by displaying panels bearing indicia selected by the user. Moreover, a user may customize a blank panel by imprinting thereon messages or artwork of his or her own creation.

It is a very simple matter to change the panels; the socket means of a panel is simply slid off its associated mounting member and another socket means secured to or integrally formed with another panel is slid onto said mounting member. This enables a user to change the panels daily or even more frequently if desired.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device that is removably attachable to a mailbox, comprising:

a base member formed of a preselected flexible and resilient material;

said base member having an arch-shaped top part adapted to overlie a mailbox of the type having an arch-shaped top wall;

said base member having a pair of transversely opposed arms that are formed integrally with said top part and which respectively extend from opposite ends of said top part;

said pair of arms being adapted to overlie opposing side walls of said mailbox so that said pair of arms grips said opposing side walls when said device is attached to said mailbox;

a return bend formed in a free end of each arm of said pair of arms;

a straight mounting member integrally formed with each of said return bends and each mounting member being disposed in substantially parallel relation to said arms in closely spaced apart relation thereto;

a first panel member having a first side adapted to have indicia disposed thereon; and said first panel member having a socket means on a second side thereof, said socket means being adapted to releasably engage a preselected mounting member;

whereby indicia disposed on said first side of said first panel member is displayed for viewing when said first panel member is engaged to one of said straight mounting members.

2. The device of claim 1, wherein said arms of said pair of arms are disposed in slightly converging relation to one another when in repose so that said pair of arms grips said opposing side walls when said device is attached to said mailbox.

3. The device of claim 1, wherein said base member has a nominal longitudinal extent relative to a longitudinal extent of a mailbox of said type.

4. The device of claim 1, further comprising:

a second panel member having a first side adapted to have indicia disposed thereon; and said second panel member having a socket means secured to a second side thereof, said socket means being adapted to releasably engage a preselected mounting member;

whereby indicia disposed on said first side of said second panel member is displayed for viewing when said second panel member is engaged to one of said straight mounting members.

5. The device of claim 4, wherein said socket means is an elongate hollow socket member that is closed on three sides by side walls that are disposed normal to said second side of said second panel and that is open on a fourth side, said fourth side providing an opening for slideably receiving a straight mounting member within said socket means.

6. The device of claim 5, further comprising a flange means connected to said side walls, said flange means disposed in overlying relation to said second side of said second panel to facilitate and stabilize connection of said socket means to said second side.

7. The device of claim 1, wherein said socket means is an elongate hollow socket member that is closed on three sides by side walls that are disposed normal to said second side of said first panel and that is open on a fourth side, said fourth side providing an opening for slideably receiving a straight mounting member within said socket means.

8. The device of claim 5, further comprising a flange means connected to said side walls, said flange means disposed in overlying relation to said second side of said first panel to facilitate and stabilize connection of said socket means to said second side.

9. The device of claim 1, wherein said socket means is an elongate hollow socket member integrally formed with said panel, said hollow socket member being closed on three sides by side walls that merge gradually with said second side of said panel and being open on a fourth side to provide an opening for slideably receiving a straight mounting member.

10. A mailbox clip that is releasably attachable to a mailbox for decorative purposes, comprising:

an arch-shaped top part adapted to overlie an arch-shaped top wall of a mailbox of the type having an arch-shaped top wall;

a pair of arm members integrally formed with respective opposite ends of said arch-shaped top part and extending therefrom in transversely opposed relation to one another, said pair of arm members having a common length;

said pair of arm members being disposed in slightly convergent relationship to one another so that they cooperatively grip opposite side walls of a mailbox to which said mailbox clip is attached;

each of said arm members terminating in an integrally formed return bend;

a straight mounting member integrally formed with each of said return bends, each straight mounting member being disposed in substantially parallel, closely spaced relation to an associated arm member and said straight mounting members having a common length substantially equal to the common length of said arm members; and a first and a second panel member, each of which has a first side adapted to have a preselected indicia disposed thereupon and each of which has a second side adapted for releasable attachment with one of said straight mounting members.

11. The mailbox clip of claim 10, further comprising an elongate hollow socket means secured to each of said second sides, each of said elongate socket means adapted to slideably receive an associated straight mounting member.

12. The mailbox of claim 11, wherein each of said elongate socket means includes three side walls disposed normal to said second side and an opening flush with a peripheral edge of its associated panel member for receiving a straight mounting member.

13. The mailbox of claim 12, wherein each of said socket means includes a flange connected to each of said three side walls, each flange overlying said second side of its associated panel member to facilitate attachment of said socket means to said second side and to stabilize said connection.

14. The mailbox of claim 10, further comprising an elongate hollow socket means integrally formed with at least one of said second sides, said elongate hollow socket means adapted to slideably receive an associated straight mounting member.

* * * * *